US005887731A

United States Patent [19]

Thalenfeld

[11] Patent Number: 5,887,731

[45] Date of Patent: Mar. 30, 1999

[54] ALL-PLASTIC MERCHANDISE DISPLAY HOOK WITH LABEL HOLDER

[75] Inventor: David R. Thalenfeld, Bear Creek, Pa.

[73] Assignee: Trion Industries, Inc., Wilkes-Barre, Pa.

[21] Appl. No.: 891,172

[22] Filed: Jul. 10, 1997

[51] Int. Cl.[6] ..... A47F 5/00

[52] U.S. Cl. ..... 211/57.1; 211/103; 211/106; 248/222.51; 248/223.31

[58] Field of Search ..... 211/57.1, 59.1, 211/106, 103, 181.1, 94.01; 248/222.12, 222.51, 223.31, 223.41, 224.51, 220.21, 214

[56] References Cited

U.S. PATENT DOCUMENTS

| | | | |
|---|---|---|---|
| 2,640,600 | 6/1953 | Farr | 211/106 |
| 2,754,974 | 7/1956 | Larson . | |
| 3,659,722 | 5/1972 | Carroll | 211/106 |
| 4,540,093 | 9/1985 | Merl et al. | 211/59.1 |
| 4,832,298 | 5/1989 | Metcalf | 211/59.1 X |
| 5,038,943 | 8/1991 | Reinke | 211/59.1 |
| 5,080,238 | 1/1992 | Hochman | 211/59.1 |
| 5,235,766 | 8/1993 | Fast et al. | 211/59.1 X |
| 5,442,872 | 8/1995 | Moser . | |
| 5,588,543 | 12/1996 | Finger | 211/106 X |
| 5,702,008 | 12/1997 | Thalenfeld et al. | 211/57.1 |

*Primary Examiner*—Robert W. Gibson, Jr.
*Attorney, Agent, or Firm*—Schweitzer Cornman Gross & Bondell LLP

[57] ABSTRACT

An integrally formed, injection molded merchandise display hook for mounting on spaced-apart, parallel rods has a resiliently-deformable mounting clip adapted to mount to the rods, and a label support arm and a merchandise support arm extending outwardly from the mounting clip. A stabilizing member spans between the label support arm and the merchandise support arm and is spaced a short distance from the mounting clip to provide rigidity and to maintain the arms in a parallel relationship.

3 Claims, 2 Drawing Sheets

ALL-PLASTIC MERCHANDISE DISPLAY HOOK WITH LABEL HOLDER

BACKGROUND AND SUMMARY OF THE INVENTION

Display hooks, which are removably mountable on fixed support structure, are in widespread usage for displaying carded merchandise for sale. In many cases, such merchandise display hooks are combined with label-mounting means for presenting product information and pricing in association with the carded merchandise. A common form of such label-mounting means consists of a label support arm projecting above and generally parallel to a merchandise supporting arm, which label support arm holds a label-holding device, such as a pivoting label holder, at its forward extremity, advantageously in a position directly in front of the outer end of the merchandise display hook. The label-mounting means, in such cases, serves an additional function as a means for guarding the outer end of the display hook element against accidental contact.

One form of mounting means for such display hooks comprises a snap-on mounting clip adapted to be mounted on a suitable support structure, such as horizontal cross bars or on spaced-apart, parallel rods, such as in the ladder rack strip structure described in the applicant's co-pending application Ser. No. 657,797, the disclosure of which is herein incorporated by reference.

The present invention is directed to a merchandise display hook of the general type described above which is adapted to be formed from a unitary piece of injection molded plastic. To this end, the device of the invention includes an integral mounting clip adapted to be removably mounted on the support structure, such as the cross bar or rack strips previously referred to. The merchandise support arm and label support arm are parallel and extend outwardly from the mounting clip, and the label support arm can include a cross bar element, as discussed above, for pivotal support of a label holder. The mounting clip and support arms are formed as a unitary injection molding of plastic material. Pursuant to the invention, a stabilizing member spans between the merchandise support arm and the label support arm at a short distance spaced outwardly from the mounting clip to maintain the support arms in parallel relation, and to aid in mounting and removal.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
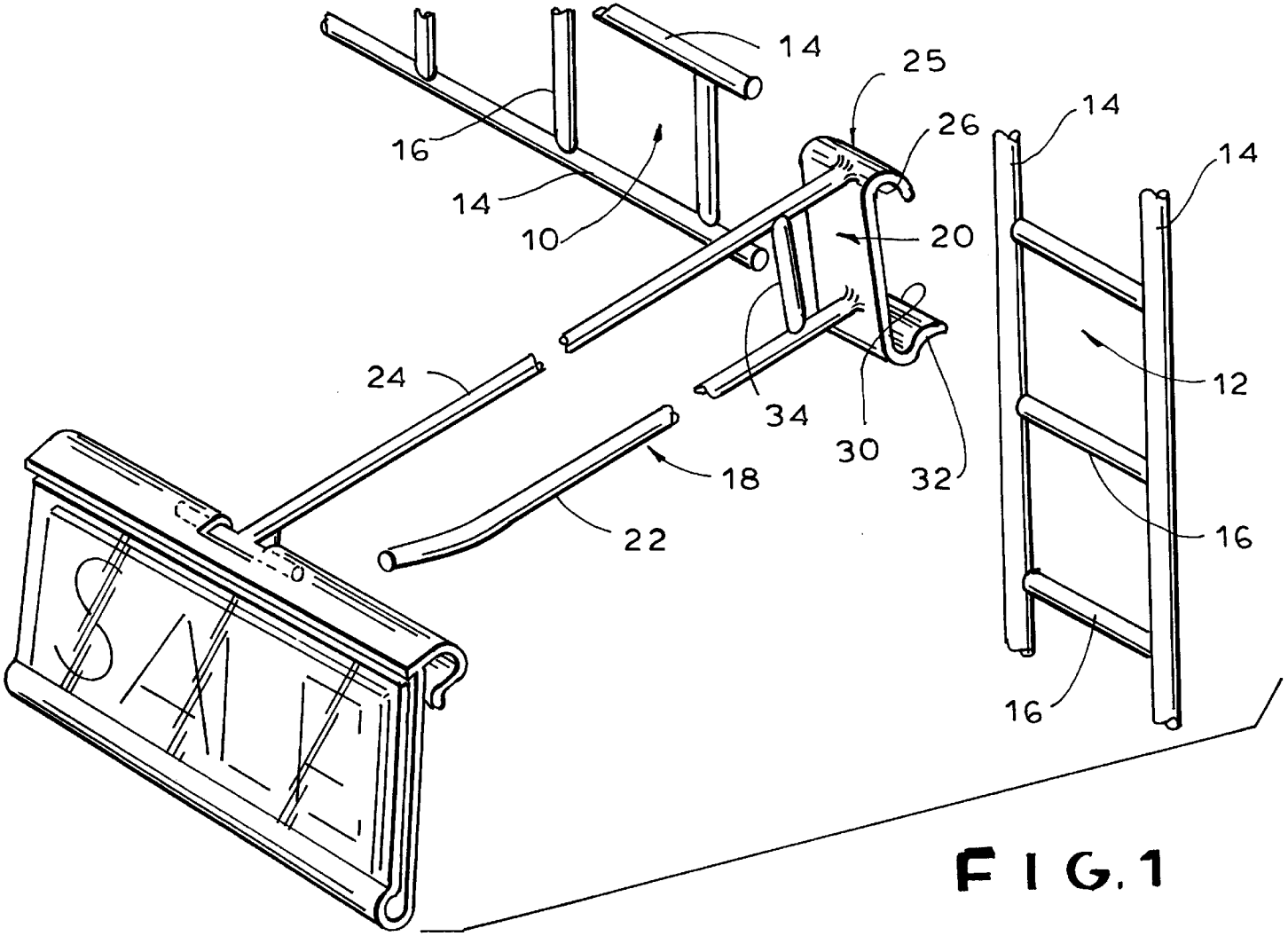
FIG. 1 is a perspective view of one preferred embodiment of a merchandise display hook according to the invention.
Figure 2:
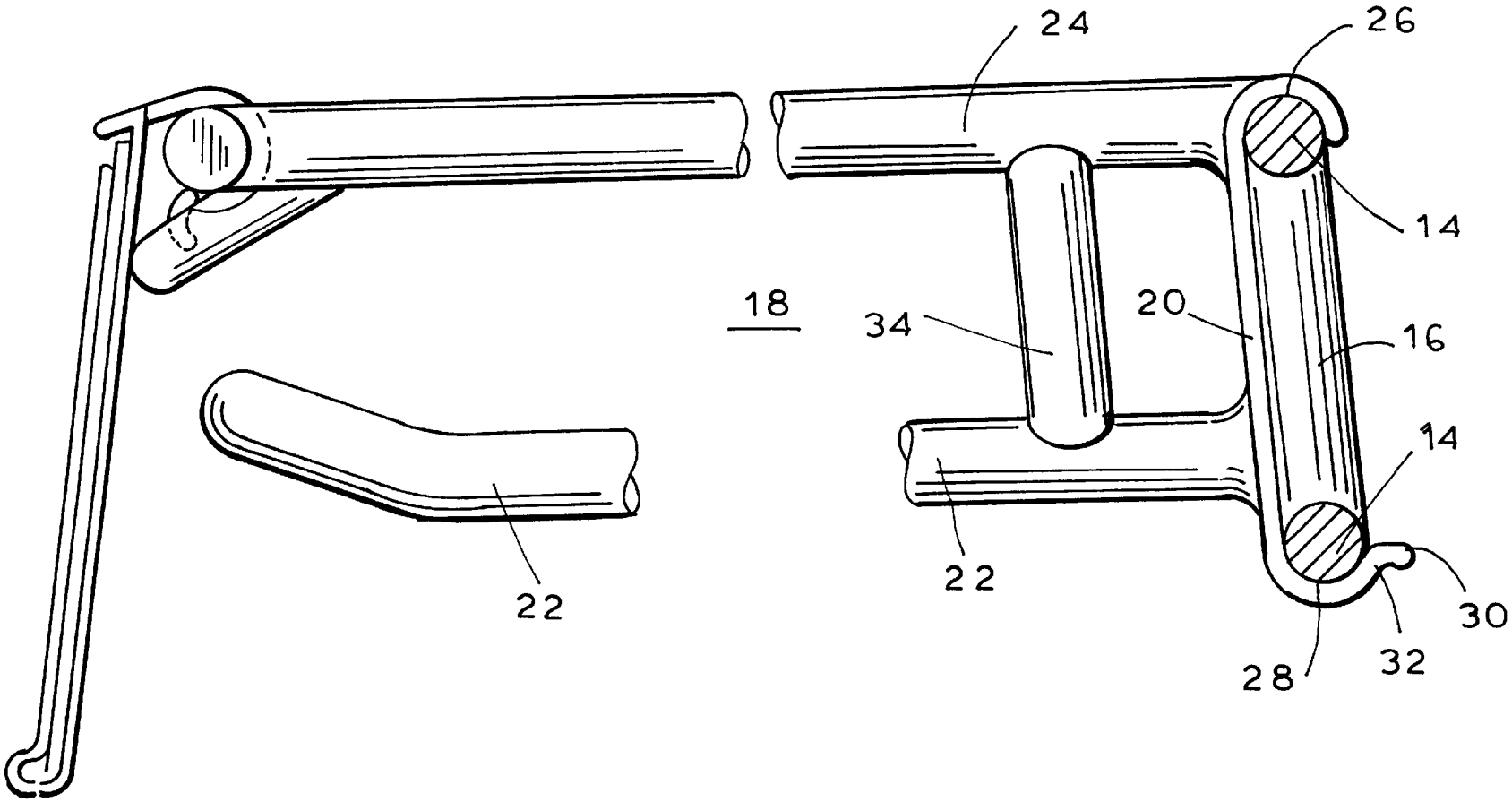
FIG. 2 is a fragmentary side elevational view of the display hook of FIG. 1.

Referring now to the drawing, and specifically to FIGS. 1 and 2 thereof, the reference numerals 10 and 12 designate separate sections of ladder rack strip each with spaced-apart, parallel rods forming two parallel rails 14 and a plurality of equally-spaced, parallel rungs 16. This type of ladder rack strip, which is disclosed in applicant's co-pending U.S. application Ser. No. 657,797, is produced by a novel method whereby the rungs 16 are connected to interior portions of the rails 14 and whereby the rails 14 and rungs 16 are spaced uniformly such that the distance between adjacent rungs is substantially equal to the distance between the rails 14. While this is one preferred type of support structure for the present invention, other types of support structure are equally suitable, such as steel cross bars of appropriate cross section (not shown) as commonly used by chain stores, for example. Typically such cross bars may be about 3/16"×1" in cross section, with rounded edges.

The device of the present invention comprises a merchandise display hook generally indicated at 18 having a mounting portion 20 with a merchandise display arm 22 and a label supporting arm 24 joined integrally therewith and extending outwardly therefrom. The mounting portion 20, which attaches to a support structure, comprises a resilient, snap-on mounting clip 25 of generally known shape having two opposed channels 26, 28. The arms 22, 24 and mounting clip 25 constitute unitary injection molding of a suitable structural plastic material to reduce cost and weight. At least one of the clip channels 26, 28 includes a guide flange 30 extending from a free end 32 thereof, which guide flange 30 is adapted to permit the mounting clip 25 to be removably mounted on the support structure. The channels 26, 28 are shaped and located so as to rigidly secure the merchandise display hook 18 to a ladder rack strip 10, 12 once mounted.

In a preferred form of the invention, the upper clip channel is generally aligned with the label holding arm 24, and the lower clip channel 28 is at least slightly below the lower arm 22 to facilitate limited flexing of the lower portion of the clip during installation and removal of the device.

During mounting of the type of mounting clip 25 shown, one of the channels 26 is placed over one edge portion of the support structure (for example, either a rail 14 or rung 16 of the ladder rack strips 10, 12 or one edge of a cross bar element) and the merchandise display hook 18 is rotated such that the guide flange 30 contacts an opposed rod or edge. The guide flange 30 is then urged over the opposed rod or edge by applying torque which resiliently deforms the mounting clip 25. Preferably, the channel 26 opposite the guide flange 30 is adapted to contact a rod or edge over a substantial arc, preferably more than 180°, such that, when mounted thereon, the channel 26 forms a pivotal connection with the support structure.

The above described mounting clip 25 provides an effective and efficient means for mounting the merchandise display hook 18. However, slight variances in the dimensions and shape of the support structure (e.g., ladder rack strip 10, 12) and/or the clip 25 can cause the mounting clip 25 to deform, tending to cause the label support arm 24 and merchandise support arm 22 to either converge or diverge. The tendency of this angular displacement results from the fact that the components of the merchandise display hook 18 are formed of a unitary molding plastic, as intended. To maintain the label support arm 24 and merchandise support arm 22 in a desired parallel relation, an integrally-formed stabilizing member 34 is located to extend between inner end portions of the label support arm 24 and merchandise support arm 22, spaced a short distance from the mounting clip 25. For example in a molded plastic hook having upper and lower arms of about four inches in length and about 3/16 inch in diameter, a stabilizing element of similar diameter may conveniently be positioned about 1/4–3/8 inch in front of the clip 25. The stabilizing member 34 provides substantial rigidity to the geometry of the label support arm 25 and merchandise support arm 22 and maintains them in substantially parallel relation irrespective of minor variances in the configuration of the clip 25 and/or the support structure.

In addition, the stabilizing member 34 provides extra rigidity to the label support arm 25 and merchandise support arm 22 during mounting and removal. That is, to mount and remove the merchandise display hook 18, force is typically applied to one or both of the merchandise support arm 22 or label support arm 24 to rotate the mounting clip 25 about one side of the ladder rack strip 10, 12 or other support structure. This force would ordinarily cause the plastic, cantilevered support arms 22, 24 to bend a significant amount. However, the stabilizing member 34 reduces the amount by which the merchandise support arm 22 and the label support arm 24 deflect or bend under such force.

The device of the present invention is particularly advantageous in that it enables a merchandise support hook, of the described type, to be manufactured as a unitary injection molded article of suitable structural plastic material. This enables the article to be mass produced on a highly economical basis. A significant feature of the new device is the provision of a rigid stabilizing element extending between the upper and lower arms of the device, at a location spaced a short distance in advance of the clip element, by which the device is mounted on a support structure. This not only strengthens the assembly for installation and removal, but more importantly assures that the upper and lower arms remain in a substantially parallel orientation, notwithstanding stresses and distortions placed upon the mounting clip, which can result from minor dimensional variations in the spacing and configuration of the parallel rods on which the device is mounted and/or in the clip itself.

It should be understood, of course, that the specific form of the invention herein illustrated and described is intended to be representative only. In this respect, the specific form of the merchandise display hook employing the mounting clip and stabilizing member may take any of a variety of forms. Accordingly, reference should be made to the following appended claims in determining the full scope of the invention.

I claim:

1. A merchandise display hook for mounting on a support structure having opposed edge portions, which merchandise display hook is a one-piece injection molded plastic unit and comprises, (a) a resiliently deformable mounting clip having opposed channels adapted to engage said opposed edges of said support structure, (b) a label support arm and a merchandise support arm integral with and extending outwardly from said mounting clip in vertically spaced-apart relation, (c) a stabilizing member integral with and spanning between said label support arm and said merchandise support arm at a location spaced a short distance outwardly from said mounting clip, (d) whereby said resiliently deformable mounting clip allows the merchandise display hook to be mounted on said support structure, and said stabilizing member maintains said label support and merchandising support arms in substantially parallel relation.

2. A merchandise display hook for mounting on a support structure having opposed edge portions, which merchandise display hook comprises, (a) a resiliently deformable mounting clip adapted to mount on said support structure, (b) a label support arm and a merchandise support arm extending outwardly from said mounting clip, (c) a stabilizing member spanning between said label support arm and said merchandise support arm at a location spaced a short distance outwardly from said mounting clip, (d) said mounting clip, said label support arm, said merchandise support arm and said stabilizing member being integrally formed as an injection molded plastic unit, (e) whereby said resiliently deformable mounting clip allows the merchandise display hook to be mounted on said support structure, and said stabilizing member maintains said label support and merchandising support arms in substantially parallel relation, (f) said support structure comprising spaced apart parallel rods, (g) said mounting clip further comprising first and second opposed channels adapted to engage said parallel rods, and (h) said clip further comprising a guide flange extending from a free end of said first channel, (i) said guide flange being adapted to engage one of said rods and to guide an associated channel thereover during mounting of the merchandise display hook.

3. A merchandise display hook as in claim 2, wherein said second channel is adapted to engage one of said rods over an angle of greater than 180 degrees to provide a removable pivotal connection thereto to aid in mounting and removal.

* * * * *